United States Patent [19]

Whiting et al.

[11] Patent Number: 4,606,596

[45] Date of Patent: Aug. 19, 1986

[54] STRESS RELIEF APPARATUS FOR ELECTRICAL CONNECTORS

[75] Inventors: David E. Whiting, Dillsburg, Pa.; Mark S. Schell, Palatine, Ill.

[73] Assignee: E. I. Du Pont de Nemours and Company, Wilmington, Del.

[21] Appl. No.: 672,901

[22] Filed: Nov. 19, 1984

[51] Int. Cl.[4] ..... H01R 13/58

[52] U.S. Cl. ..... 339/107

[58] Field of Search ..... 339/103 R, 103 M, 107, 339/208, 210 R, 210 M, 63 R, 63 M

[56] References Cited

U.S. PATENT DOCUMENTS

| | | | |
|---|---|---|---|
| 3,622,942 | 11/1971 | Rynk | 339/107 |
| 3,638,169 | 1/1972 | Caveney et al. | 339/107 |
| 3,781,766 | 12/1973 | Teagno et al. | 339/107 |
| 3,920,306 | 11/1975 | Barnett, Jr. et al. | 339/107 |
| 4,125,312 | 11/1978 | Aimar | 339/107 |
| 4,327,956 | 5/1982 | Sitzler | 339/107 |
| 4,436,361 | 3/1984 | McCleerey | 339/97 P |
| 4,443,048 | 4/1984 | Moist | 339/63 M |
| 4,449,778 | 5/1984 | Lane | 339/107 |
| 4,544,220 | 10/1985 | Aiello et al. | 339/59 M |

FOREIGN PATENT DOCUMENTS 0112713 7/1984 European Pat. Off. .

OTHER PUBLICATIONS

Berg Power-Mate System, 5200 Bulletin, Nov. 1982, Du Pont Company, Berg Electronics, Camp Hill, Pa. 17011.

*Primary Examiner*—Gil Weidenfeld
*Assistant Examiner*—Gary F. Paumen

[57] ABSTRACT

Apparatus for relieving stress between an electrical connector component and the plurality of individual wires terminating at the connector component. The apparatus includes two identical interlocking stress relief elements, each of which releasably engages the connector component. The elements gather the wires together into a group or bundle and allow a wire tie to be applied around the elements and the gathered wires.

10 Claims, 6 Drawing Figures

STRESS RELIEF APPARATUS FOR ELECTRICAL CONNECTORS

BACKGROUND OF THE INVENTION

This invention relates to electrical connectors, and more particularly to stress relief apparatus for electrical connectors at which a plurality of individual electrical conductors terminate.

Electrical connectors for mechanically and electrically interconnecting groups of individual electrical conductors are well known. These connectors takes many forms and have a wide variety of applications. In many of these applications it is sometimes necessary to disconnect the connectors for such purposes as maintenance and repair of the associated apparatus. When this is done, there is often a tendency for the person working on the apparatus to attempt to disconnect the connector by pulling on the wires leading to the connector. This tendency may be due to the relatively small size of many connectors, to their relative inaccessibility in the apparatus, or the like.

Strain on the connector wires can be detrimental to the connector. It can result in one or more wires being pulled from the connector. It can result in dislocation of one or more terminals in the connector. And it can result in damage to the connector housing. Any of these occurrences can in turn cause failure of one or more of the electrical connections provided by the connector. In complicated electrical equipment such failures can be extremely difficult to locate. The risk of such damage to the connector is increased if the male and female parts of the connector are latched together.

In view of the foregoing, it is an object of this invention to provide apparatus for reducing the risk of damage to an electrical connector resulting from lateral movement of the individual wires terminating at the connector.

It is another object of this invention to provide stress relief apparatus for electrical connectors at which several individual wires terminate, the stress relief apparatus being simple and inexpensive to manufacture and install but extremely effective in preventing the wires from being pulled out of the connector.

SUMMARY OF THE INVENTION

These and other objects of the invention are accomplished in accordance with the principles of the invention by providing stress relief devices that are made up of two identical hermaphroditic parts which can be coupled together around the rear of a connector housing. The stress relief device is mechanically coupled to the associated connector housing and has a rearwardly extending neck portion for gathering together the wires extending from the connector housing. The neck portion of the stress relief device provides a site for application of a wire tie around the stress relief device and the gathered wires.

Further features of the invention, its nature and various advantages will be more apparent from the accompanying drawings and the following detailed description of the invention.

DETAILED DESCRIPTION OF THE INVENTION

Figure 1:
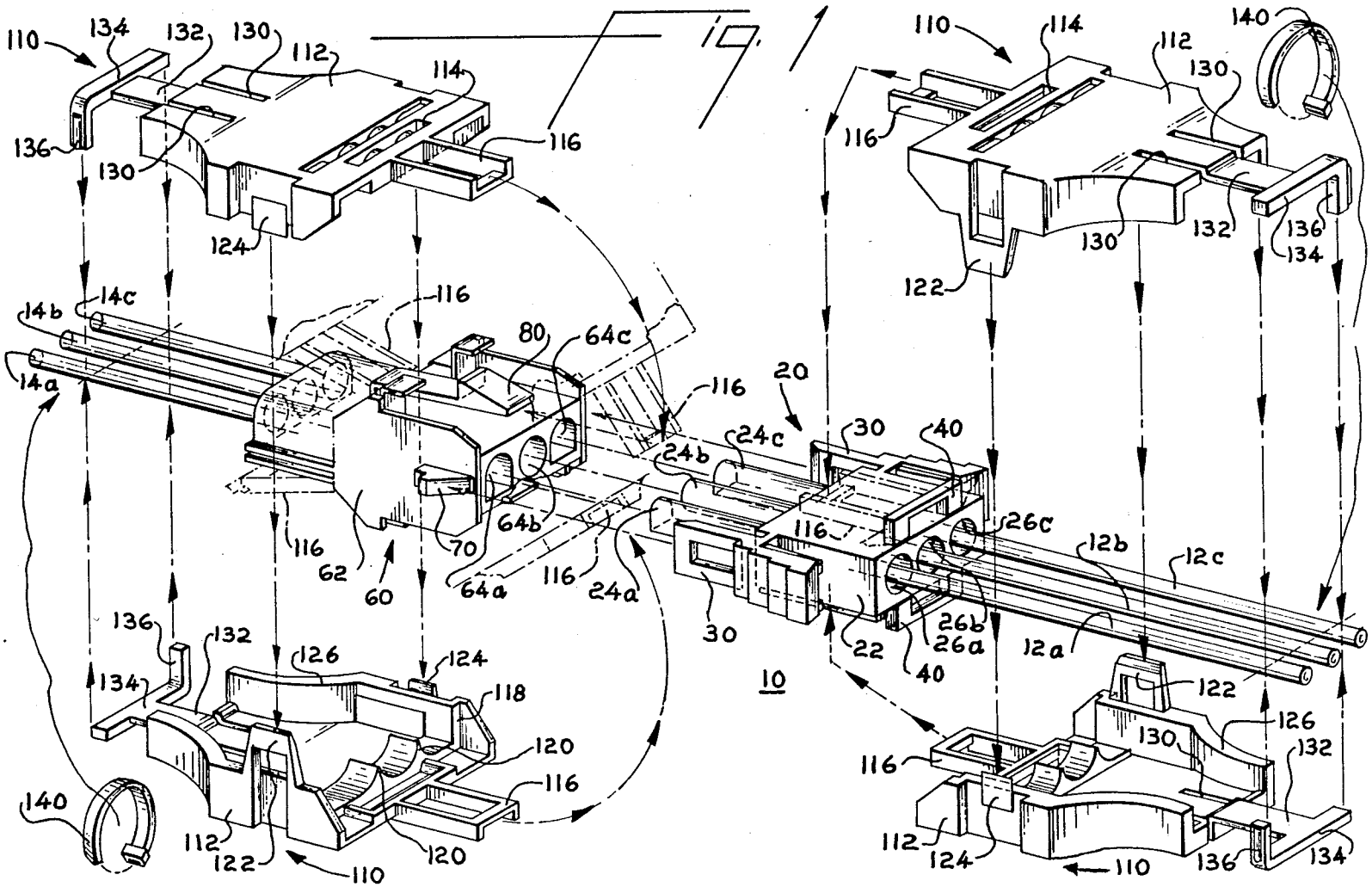
FIG. 1 is an exploded perspective view of two mating connectors, each of which is provided with an illustrative embodiment of the stress relief device of this invention.
Figure 2:
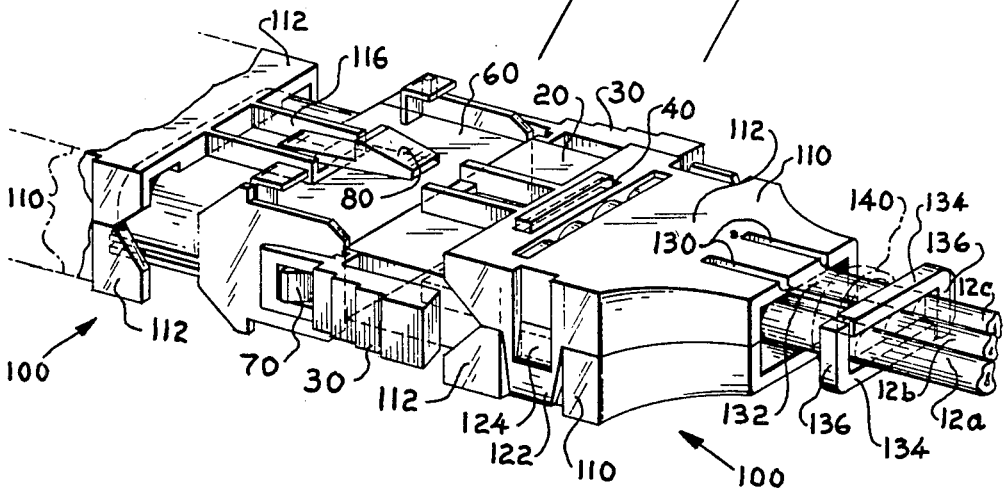
FIG. 2 is an unexploded partial perspective view of the apparatus of FIG. 1.
Figure 3:
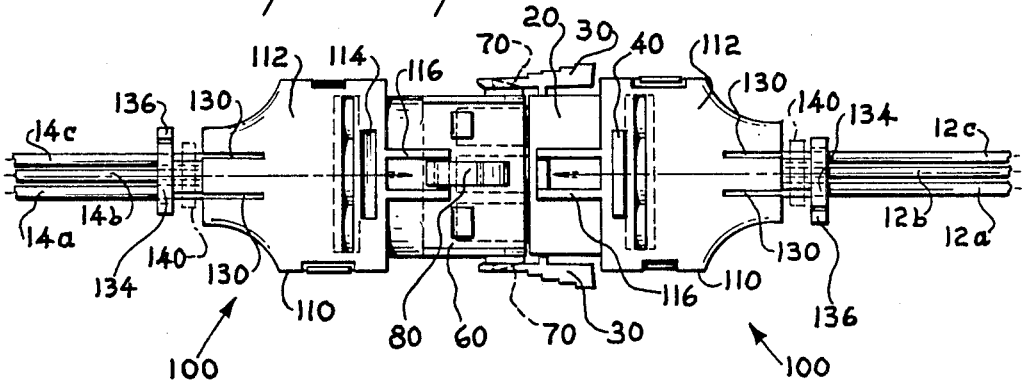
FIG. 3 is a plan view of the apparatus of FIG. 2.
Figure 4:
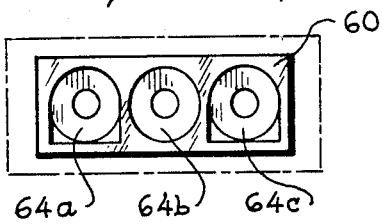
FIG. 4 is a simplified end view of the left-hand connector in FIG. 1.

As shown in FIGS. 1–4 an illustrative three-wire connector 10 includes plug portion 20 and cap portion 60. Plug portion 20 includes a housing 22 having three parallel, laterally spaced, tubular prongs 24*a*, 24*b*, and 24*c* projecting forwardly from the housing. Cap portion 60 includes a housing 62 having three apertures 64*a*, 64*b*, and 64*c*, each of which removably receives a respective one of prongs 24*a*, 24*b*, and 24*c*. A male terminal pin (not shown) is located inside each prong 24. A female terminal socket (also not shown) is located inside each aperture 64 for removably receiving an associated male terminal pin when plug 20 and cap 60 are pushed together.

The terminal pins and sockets are metal. Plug 20 and cap 60 are typicallly molded of a synthetic polymer such as unfilled nylon. In addition to supporting the male terminal pins, housing 22 physically separates and electrically insulates those pins from one another. Housing 62 performs similar functions with respect to the female terminal sockets.

Three separate insulated wires 12*a*, 12*b*, and 12*c* extend into the rear of housing 22 via apertures 26*a*, 26*b*, and 26*c*, respectively. Apertures 26 are respectively continuous with the interiors of prongs 24 in which the above-mentioned male terminal pins are mounted. Each of wires 12 is electrically and mechanically connected to a respective one of the terminal pins inside housing 22. Three other separate insulated wires 14*a*, 14*b*, and 14*c* extend into the rear of housing 62 via the rear end portions of apertures 64*a*, 64*b*, and 64*c*, respectively. Each of wires 14 is electrically and mechanically connected to a respective one of the above-mentioned female terminal sockets in apertures 64.

Prongs 24 and the mating portions of apertures 64 are configured so that plug 20 and cap 60 will only fit together in one relative angular orientation of elements 20 and 60. In the depicted apparatus this is accomplished by the "D" cross sectional shapes of prongs 24*a* and 24*c*, and the corresponding cross sectional shapes of apertures 64*a* and 64*c*. This assures that connector 10 will always connect wire 12*a* to wire 14*a*, wire 12*b* to wire 14*b*, and wire 12*c* to wire 14*c*.

Plug 20 and cap 60 include a number of conventional exterior features that are used for mechanically latching and therefore securing such components together. In the depicted apparatus plug 20 is mechanically latched to cap 60 by latches 30 on housing 22 engaging lugs 70 on housing 62. Latches 30 are connected to housing 22 by flexural hinges so that as plugs 20 and cap 60 are pushed together, latches 30 deflect outwardly and then spring back to their initial portions to engage the rearwardly facing surfaces of lugs 70. If it is desired to disconnect connector 10, the rearwardly extending portions of latches 30 are squeezed in toward housing 22, thereby pivoting the forwardly extending portions of latches 30 out of engagement with lugs 70. Plug 20 and cap 60 can then be pulled apart.

Other conventional exterior latching features are provided but are not used in the depicted apparatus for latching plug 20 and cap 60 together. Instead, some of these features are used for attaching the stress relief device of this invention to plug 20 and cap 60. These features include tabs 40 which extend laterally outward from the top and bottom of plug housing 22. Other features of this kind are latches 80 which are cantilevered forwardly from the mid-portion of the top and bottom of cap housing 62.

A stress relief device 100 according to this invention is provided for each plug 20 and cap 60. Although plug 20 and cap 60 are quite different from one another, the same stress relief device is usable on both of these components. This reduces the number of parts that must be manufactured and kept on hand to provide stress relief devices. In addition, each stress relief device 100 is made up of two identical stress relief elements 110. Thus all four of the stress relief elements 110 shown in FIG. 1 are identical. Stress relief devices 100 may be made of the same material as housings 22 and 62.

Each stress relief element 110 includes a main body portion 112 having a forward portion, which fits up against the rear of one of connector components 20 or 60, and a rear portion, which tapers inwardly in the direction away from the associated connector component to form a neck portion of the stress relief device. The forward portion of body 112 includes a transverse tab slot 114 for receiving one of tabs 40 when the stress relief element is associated with plug 20. Projecting forwardly from body 112 is an open rectangular stirrup 116 which hooks over one of latches 80 when the stress relief element is associated with cap 60. Features 114 and 116 cooperates with the associated connector component structures 40 and 80, respectively, to prevent the stress relief devices from being pulled rearwardly off the associated connector component 20 or 60.

Just to the rear of tab slot 114 is an inwardly projecting transverse shoulder 118 for abutting the rear surface of the associated connector component 20 or 60. Shoulder 118 prevents the stress relief device from being pushed forwardly relative to the associated connector component 20 or 60. This is especially important when the stress relief device is associated with cap 60. Shoulder 118 includes peaks 120 which project between the wires entering the associated connector component to increase the bearing area between the stress relief device and the associated connector component.

The two elements 110 which make up each stress relief device 100 latch together by means of latches 122 and tabs 124. Each stress relief element 110 has a latch 122 on one side and a tab 124 on the other side so that when two elements are turned toward one another, the latch on each element can be engaged with the tab on the other element. Because each element 110 has a latch and a tab, the elements are referred to herein as hermaphroditic.

Elements 110 abut on another along planar surfaces 126 which are substantially parallel to the longitudinal axis of connector 10. Both latch 122 and tab 124 project beyond the surface 126 of each element 110 toward its element 110. Latch 122 and tab 124 are both on the outside of element 110. Accordingly, each element 110 fits between the latch 122 and tab 124 of the other element 110 when the stress relief device is assembled. This prevents the two elements 110 from shifting sideways relative to one another (in the plane of FIG. 3).

The surface of tab 124 that faces the latch 122 on the same element 110 is inclined away from that latch in the direction away from surface 126. This facilitates assembly of two elements 110 merely by pressing the two elements together. As the two elements are pressed together, each of latches 122 deflects outwardly in order to ride over the adjacent tab 124 on the other element. Then, just as surfaces 126 on the two elements come together, the latching end portion of each latch 122 passes the adjacent tab 124. This allows latch 122 to return to its undeflected position and engage the surface of tab 124 which faces away from the surface 126 of the element on which the tab is mounted, thereby preventing separation of elements 110 unless latches 122 are deliberately deflected outward.

The rear or neck portion of each element 110 includes two axially extending, laterally spaced slots 130. The portion of element 110 between slots 130 is extended rearwardly to form a tail member 132. Tail member 132 terminates in a transverse member 134 having an inwardly extending leg 136 at one end of the transverse member. The leg 136 on each element 110 extends toward but beyond the legless end of the transverse member 134 on the other element. When two elements 110 are latched together as described above, the members 134 and 136 on those elements form a compressible rectangle through which all of the wires entering the associated connector component 20 and 60 pass. This rectangular shape helps to hold the wires together in a group during assembly of the apparatus. In addition, the axial space coextensive with tail members 132 provides a site for application of a conventional wire tie 140. Wire tie 140 is applied around tail members 132 and wires 12 or 14. It is located between members 134 and 136 on the one hand and main body portions 112 on the other hand.

Slots 130 and the compressible nature of the rectangle formed by elements 134 and 136 allows wire tie 140 to bind tail members 132 and wires 12 or 14 tightly together. This, in combination with the necked down portion of the stress relief device, helps transfer any stress applied to wires 12 or 14 to the associated stress relief device 100 and thus to the associated connector component 20 or 60 without stressing the terminal pins or sockets in that connector component. Wire tie 140 cannot move axially because it is trapped between members 134 and 136 on the one hand and main body portions 112 on the other hand. The compressible nature of the wire tie site allows the stress relief device to be used with wires of various diameters.

Figure 5:
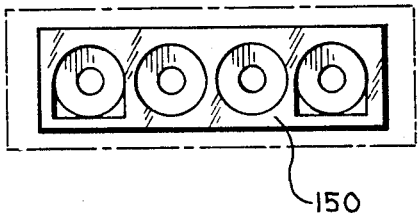
FIGS. 5 and 6 are views similar to FIG. 4 showing other known connector configurations which are representative of those that are usable with this invention.
Figure 6:
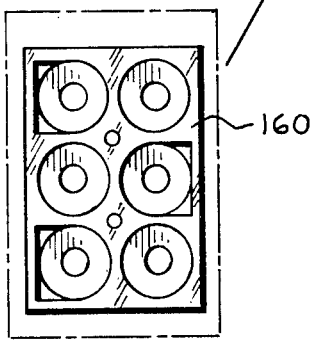

It will be readily apparent to those skilled in the art that the invention is applicable to many types of connectors other than the three-wire connector 10 shown in FIGS. 1–4. For example, FIG. 5 shows a four-wire connector 150 with which the invention can be used, and FIG. 6 shows a six-wire connector 160 with which the invention can be used.

We claim:

1. A device for relieving stress between an electrical connector component and a plurality of individual wires terminating at that connector component, all of the wires entering a rear end of the connector component and extending substantially parallel to a longitudinal axis of the connector, said connector component having a forward mating end the stress relief device comprising:

first and second hermaphroditic interlocking stress relief elements, each element including a forward position and a rear portion;

a first and a second means located at the forward portion of each stress relief element for releasably engaging the connector component to prevent relative axial motion of the stress relief element and the connector component, said first means comprising a slot and said second means comprising a stirrup extending axially along the connector component, each said stress relief element releasably engaging the connector component by means of either said slot or said stirrup, said slot being capable of receiving a tab projecting outward from the connector component and said stirrup being capable of receiving a latch member through an aperture of said stirrup, said latch member being cantilevered outward from the connector component and extending in the same direction as the stirrup to engage a nesting connector;

a latch on one side of the stress relief element and a tab on the other side, said latch on one element interlocking with the tab on the other stress relief element;

means located at the rear portion of the stress relief element and extending axially from the connector component along the wires for gathering up all the wires into a group; and means for receiving a wire tie around both elements and the gathered wires for binding the wires and the stress relief elements together.

2. The apparatus defined in claim 1 wherein the first and second stress relief elements abut one another along a planar surface which is substantially parallel to the longitudinal axis of the connector, and wherein both the latch and a portion of the tab on each stress relief element project beyond the planar surface toward the other stress relief element.

3. The apparatus defined in claim 2 wherein each stress relief element fits between the projecting portions of the latch and the tab on the other stress relief element.

4. The apparatus defined in claim 3 wherein the projecting portions of the latch and the tab on each stress relief element bear on outer surface portions of the other stress relief element to prevent relative motion of the stress relief elements parallel to the planar surface and perpendicular to the longitudinal axis of the connector.

5. The apparatus defined in claim 4 wherein the surface of the projecting portion of each tab which bears on the outer surface of the other stress relief element is inclined away from the other stress relief element in the direction away from the planar surface.

6. The apparatus defined in claim 2 wherein the latching engagement between the latches and the tabs is releasable.

7. The apparatus defined in claim 1 wherein the means extending axially from the connector component comprises a portion of the element which is inclined inwardly toward the wires in the direction away from the connector component.

8. The apparatus defined in claim 1 wherein the means for receiving a wire tie comprises a tail member projecting axially from the associated stress relief element in the direction away from the connector component, the tail member being resiliently connected to the stress relief element and having an enlargement at the end of the tail remote from the stress relief element for capturing a wire tie between the stress relief element and the enlargement.

9. The apparatus defined in claim 8 wherein the stress relief elements abut one another along a substantially planar surface which is substantially parallel to the longitudinal axis of the connector, and wherein the enlargement comprises:

a transverse member substantially parallel to the planar surface and perpendicular to the longitudinal axis of the connector; and a leg substantially perpendicular to the transverse member at one end thereof, the leg projecting toward the transverse member associated with the other stress relief element but being located beyond the end of that other transverse member which does not have a leg projecting from it, so that when the stress relief elements are interlocked together, the enlargements form a rectangular shape through which the wires pass and are held together in a group.

10. The apparatus defined in claim 1 wherein each strain relief element further comprises a shoulder for bearing on a surface of the connector component which is transverse to the longitudinal axis and which faces in the direction in which the wires extend from the connector component.

* * * * *